US007004225B2

(12) United States Patent
Takizawa et al.

(10) Patent No.: US 7,004,225 B2
(45) **Date of Patent: *Feb. 28, 2006**

(54) INJECTION MOLDING MACHINE FOR LOW-MELTING POINT METALLIC MATERIAL

(75) Inventors: Kiyoto Takizawa, Sakaki-machi (JP); Toshiyasu Koda, Sakaki-machi (JP); Yuji Hayashi, Nagano-ken (JP); Mamoru Miyagawa, Sakaki-machi (JP)

(73) Assignee: Nissei Plastic Industrial Co., Ltd., Nagano-ken (JP)

( * ) Notice: Subject to any disclaimer, the term of this patent is extended or adjusted under 35 U.S.C. 154(b) by 8 days.

This patent is subject to a terminal disclaimer.

(21) Appl. No.: 10/766,736

(22) Filed: Jan. 28, 2004

(65) Prior Publication Data

US 2004/0182536 A1 Sep. 23, 2004

Related U.S. Application Data

(63) Continuation of application No. 09/740,513, filed on Dec. 19, 2000, now Pat. No. 6,866,088.

(30) Foreign Application Priority Data

Dec. 28, 1999 (JP) ..... 11-375370

(51) Int. Cl.
*B22D 17/00* (2006.01)

(52) U.S. Cl. ..... 164/312

(58) Field of Classification Search ..... 164/113, 164/312, 900
See application file for complete search history.

(56) References Cited

U.S. PATENT DOCUMENTS

| | | | | |
|---|---|---|---|---|
| 5,040,589 | A | 8/1991 | Bradley et al. | 164/113 |
| 5,501,266 | A | 3/1996 | Wang et al. | 164/113 |
| 5,680,894 | A | 10/1997 | Kilbert | 164/312 |
| 5,685,357 | A | 11/1997 | Kato et al. | 164/113 |
| 5,711,366 | A | 1/1998 | Mihelich et al. | 164/312 |
| 5,836,372 | A | 11/1998 | Kono | 164/113 |
| 5,865,240 | A | 2/1999 | Asuke | 164/133 |
| 5,983,976 | A | 11/1999 | Kono | 164/113 |
| 5,983,978 | A | 11/1999 | Vining et al. | 164/312 |
| 6,562,100 | B1 | 5/2003 | Takizawa et al. | 75/386 |
| 6,578,621 | B1 | 6/2003 | Takizawa et al. | 164/312 |
| 6,866,088 | B1 * | 3/2005 | Takizawa et al. | 164/312 |

FOREIGN PATENT DOCUMENTS

| | | |
|---|---|---|
| JP | 7-51827 | 2/1995 |
| JP | 9-108805 | 4/1997 |

* cited by examiner

*Primary Examiner*—Kevin P. Kerns
(74) *Attorney, Agent, or Firm*—Weingarten, Schurgin, Gagnebin & Lebovici LLP

(57) ABSTRACT

An injection molding machine for low-melting point metallic material has an injection mechanism having a melting cylinder, an injection device, and a driving device. The driving device is disposed on the rear end of the melting cylinder for driving the injection device and includes a pedestal movable to advance and retreat freely to support the injection mechanism obliquely. A nozzle touch block on a tip end portion of the pedestal is touched obliquely by the nozzle member of the melting cylinder. A frame on a rear portion of the pedestal supports a rear portion of the injection mechanism and the driving device obliquely. A nozzle touch device touches an injection nozzle to a mold in the mold clamping mechanism by moving the pedestal with the injection mechanism toward the mold clamping mechanism.

5 Claims, 4 Drawing Sheets

INJECTION MOLDING MACHINE FOR LOW-MELTING POINT METALLIC MATERIAL

This application is a continuation application under §1.53 (b) of prior application Ser. No. 09/740,513 filed Dec. 19, 2000, entitled: INJECTION MOLDING MACHINE FOR LOW-MELTING POINT METALLIC MATERIAL, now U.S. Pat. No. 6,966,088, which claims priority to Japanese patent application No. 11-375,370 filed Dec. 28, 1999.

BACKGROUND OF THE INVENTION

1. Field of the Invention

The present invention relates to an injection molding machine used in the case of melting low-melting point nonferrous metals such as zinc, magnesium, or an alloy consisting thereof completely to perform injection molding under the condition of a liquid phase.

2. Detailed Description of the Prior Art

Die casting has been used for a minting of the low-melting point nonferrous metal, however, a melt furnace for melting a metallic material completely is required in die-casting, and it has been performed by dipping out a molten metal from this melt furnace or extruding by using a plunger. Accordingly, without using a melting furnace in the same manner as the case of plastic material, it has been performed to inject and fill into a mold from a nozzle on a tip of the heating cylinder by advancing of the screw, after melting in a heating cylinder which a screw for injection is provided rotatably and movably in the axial direction to melt the powdered metallic material applied from the rear of the heating cylinder completely while transferring toward the front of the heating cylinder by rotation of the screw and to store in an antechamber of the heating chamber under the condition of the liquid phase and to weigh.

Problems in the case of adopting such injection molding for the metallic material are caused by difficulty in melting and transferring of the metallic material by rotation of the screw and unstableness in weighing.

Since most of melting in the plastic material are caused by generation of heat by shear, the screw is formed in a large diameter as it comes to a tip portion and a screw groove providing a flowing clearance for the material is formed relatively shallowly. However, since there is a difference in a frictional factor in a boundary surface of an inner wall of the heating cylinder in a molten plastic, transferring toward the front by rotation of the screw can be performed smoothly, even though the flowing clearance is formed narrowly.

In contrast to this, since the metallic material melted up to the condition of the liquid phase completely is small in a viscosity to the extent not to be compared with the plastic material, the difference in the frictional factor at the two boundary surfaces described above is practically nothing, and a transferring force by rotation of the screw such as the case of the molten plastic is hard to cause due to this reason.

Moreover, in the plastic material, it becomes high viscosity due to melting, and since a pressure caused by material which pushes back the screw to the rear is occurred as a reaction force, as being stored in the antechamber of a melting cylinder by revolution of the screw, weighing of the molten material can be controlled into a constant amount each time by controlling this retracting of the screw due to pressure caused by material, however, since a rise in pressure up to such extent that the screw is pushed back to the rear is not caused in the liquid phase that the metallic material is in low viscosity, retracting of the screw due to the pressure caused by material is hard to occur, and an amount to be stored into the antechamber also is varied, whereby weighing can not be controlled into a constant amount each time.

Moreover, the heating cylinder is heated by a band heater of the outer peripheral to maintain a predetermined temperature, however, since there is no heating means in the screw side, and it is in the condition easy to radiate heat from a rear end which a piston rod is coupled, nonuniformity in temperature is easy to occur in the molten metal within the screw groove, and it leads to an excessive supply of material to keep the screw revolving in order to prevent this, since the screw itself is combined with a material-transferring member through the revolution, therefore, it has been impossible.

SUMMARY OF THE INVENTION

The present invention is devised for solving the described-above problems in the case of injection-molding the metallic material in a molten condition, and the object of the invention is to provide an injection molding machine for a new low-melting point metal in which melting and transfer, and nonuniformity in temperature or the like in the metallic material have been solved by melting the metallic material by external heat in the melting cylinder, as well as by combining a separately movable injection member with an agitating member and provided in the melting cylinder.

The present invention for accomplishing the described-above object is an injection molding machine for low-melting point metallic material in which an injection molding machine is constituted by a melting cylinder having a weighing chamber with a required length communicating with a nozzle member within a tip portion and having a supply port on an upper side of an intermediate portion; agitating and injection means provided in the inside thereof so as to rotate or, advance or retreat freely; a device driving those means, which is arranged on an rear-end side of the melting cylinder, and the injection mechanism is provided obliquely in a manner that a nozzle member side is directed in a downward direction to a mold-clamping mechanism such that a molten metal in the inside flows down by self-weight and to be stored in a tip portion of the melting cylinder, wherein the described-above agitating and injection means is constituted by an agitating member in which agitating wings having a plurality of stripes with an external diameter approximately equal to an inner diameter of the melting cylinder are formed intermittently on an outer periphery of a tip portion of a hollow shaft portion having a through-hole at the central position and an injection plunger attached unitarily to a tip of an injection rod inserted into the described-above through-hole and provided slidably freely on a central position of the agitating member and provided on the tip of the agitating member so as to insert into the described-above weighing chamber freely.

Moreover, the described-above injection rod of the present invention has the screw shutting off a molten metal intruded into a clearance between the hollow shaft portion on the intermediate region, and the described-above injection plunger is provided with a high-temperature resistant sealing ring on the outer periphery of the tip portion and has a flowing port through a fitting groove of the sealing ring and the tip of the conical plunger in the inside.

A driving device for the described-above injection plunger of the present invention is constituted by providing a nozzle touch device constituted by a hydraulic cylinder unitarily coupled by a tie-bar, spacing a required interval on the rear-end side of the described-above melting cylinder, and provided in a downward direction on the frame by inserting supporting legs which both of them are projected and arranged toward the lower side into a pair of support shafts of an inclined upper surface of a frame installed on a pedestal on a base and constituted by the hydraulic cylinder and the rod across the hydraulic cylinder side and the upper of the tip portion of the described-above pedestal.

Moreover, a driving device for the described-above agitating member is constituted by an electric motor provided on the side of the supporting leg of the melting cylinder so as to move together with the described-above melting cylinder.

The described-above pedestal of the present invention is constituted by the nozzle touch device provided on the upper surface of the base so as to rotate or, advance or retreat freely to the described-above mold-clamping mechanism, and having a nozzle touch block on the tip, as well as provided by placing the described-above frame on the pedestal provided on the rear so as to swivel freely and constituted by the rod and the hydraulic cylinder nozzle-touching the nozzle member attached to the front of the nozzle touch block to moldings by moving the pedestal to the mold-clamping mechanism together with the frame and the described-above injection mechanism across the nozzle touch block and the rear of the upper surface of the base.

The described-above nozzle touch block of the present invention is constituted by providing the nozzle member on the front faced on the described-above mold-clamping mechanism, as well as in the upper of the inner side, communicating a gate for nozzle-touching formed on an inclined rear surface with which the nozzle member of the described-above injection mechanism touches on the nozzle member of the front surface and provided on the inclined rear surface through a hot runner bent formed within the block.

BRIEF DESCRIPTION OF THE DRAWINGS

These and other objects and advantages of the present invention will become clear from the following description with reference to the accompanying drawings.

DETAIL DESCRIPTION OF THE PREFERRED EMBODIMENT

Figure 1:
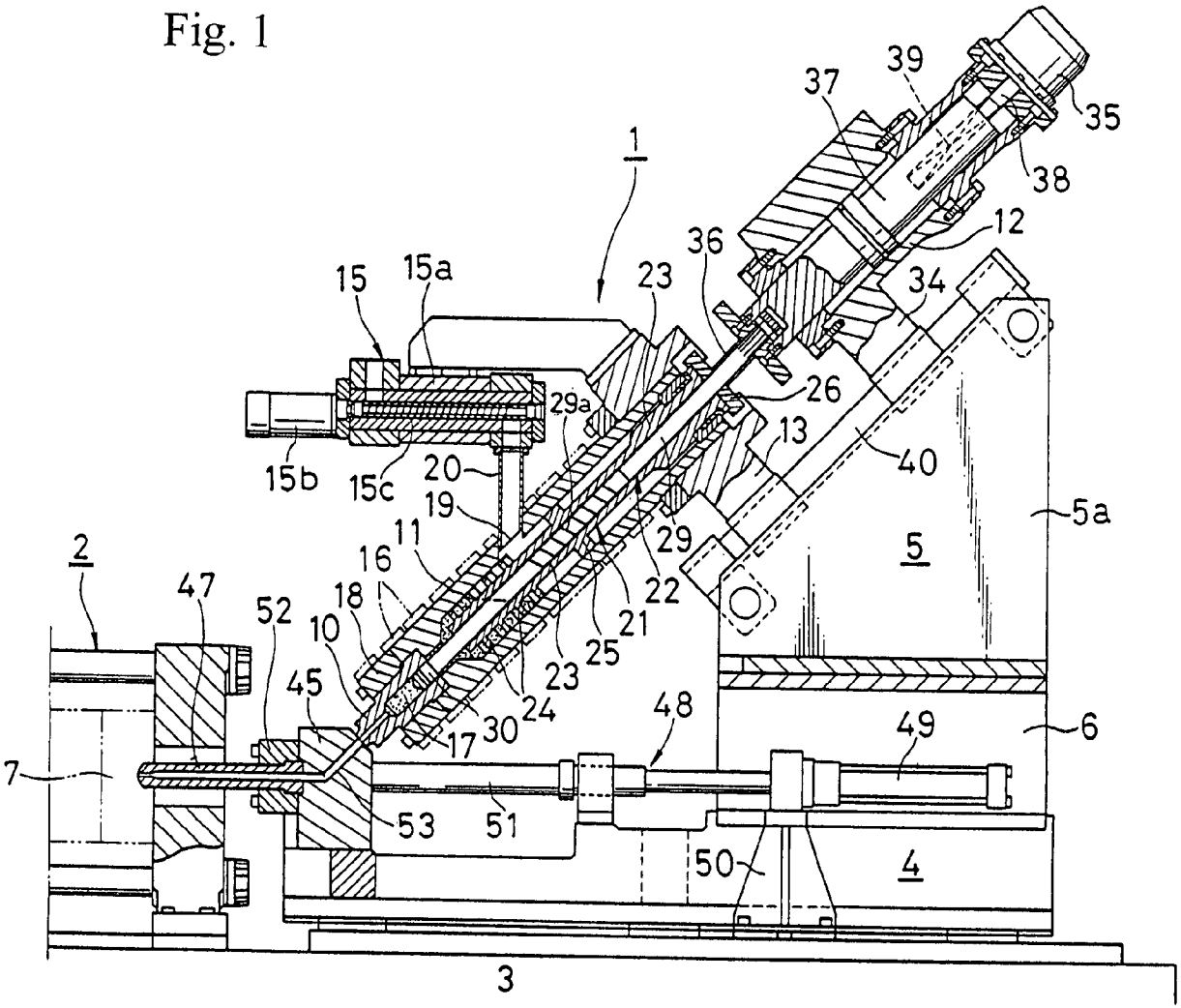
FIG. 1 is a schematically illustrated longitudinal sectional view of an injection molding machine for low-melting point metallic material according to the present invention.
Figure 2:
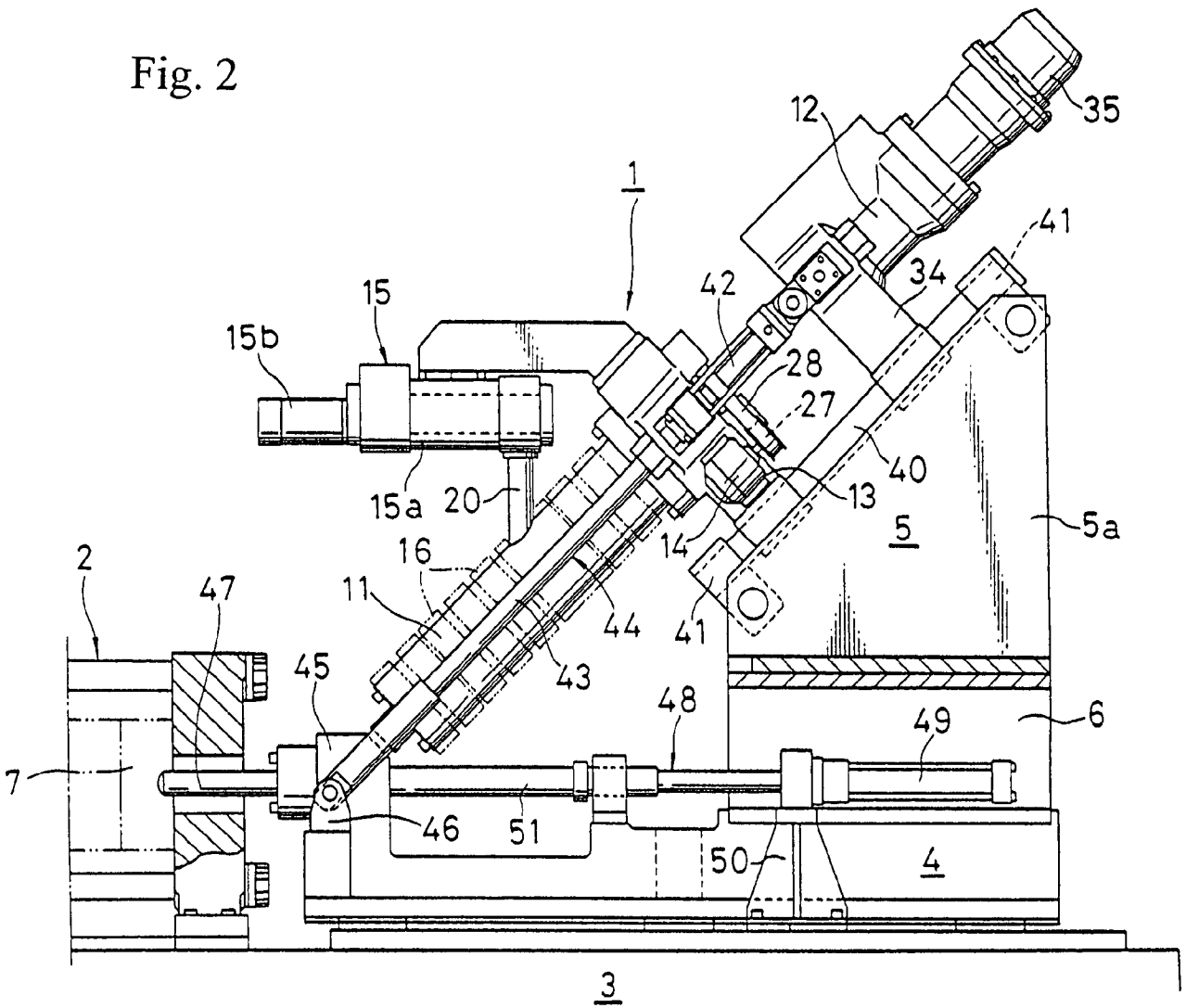
FIG. 2 is a side elevation of the injection molding machine in FIG. 1, the side elevation being partially broken away longitudinally.
Figure 3:
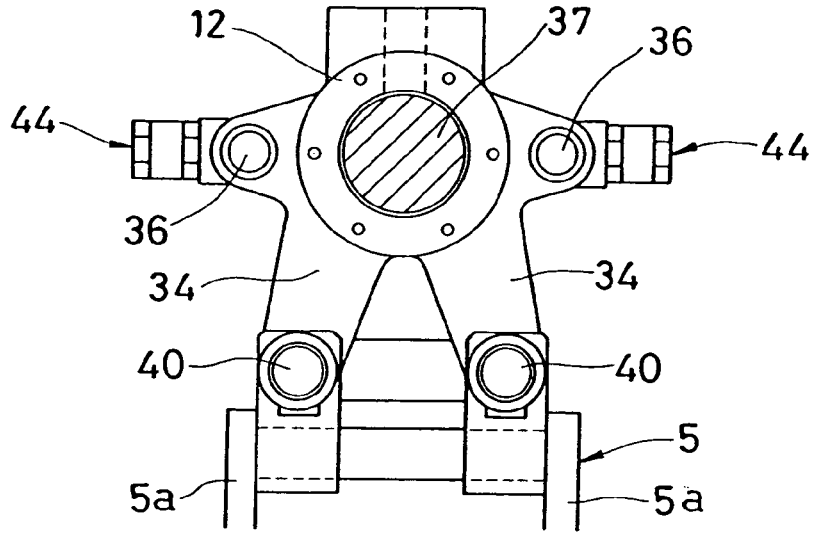
FIG. 3 is an end view of a front of an injection cylinder.

In the drawings, a reference numeral 1 is an injection mechanism and a reference numeral 2 is a mold-clamping mechanism, and are both arranged on an upper surface of a base 3. A reference numeral 4 is a pedestal 4 which is arranged so as to rotate or, advance or retreat freely to the mold-clamping mechanism 2, and a frame 5 constituted by a pair of plate bodies 5*a* which the upper surface is oblique is provided on the rear portion so as to swivel freely, and the described-above injection mechanism 1 is provided obliquely on the frame 5 in a manner that a nozzle side is directed in a downward direction to the mold-clamping mechanism 2.

The described-above injection mechanism 1 is constituted by a melting cylinder 11, agitating and injection means in the inside, which will be described hereinafter, an injection cylinder 12 provided spacing an interval on the rear-end side of the melting cylinder 11, an electric motor 14 for agitating attached to a bifurcated-shape supporting leg 13 arranged an under side of a rear end of the melting cylinder 11, and a feeding device 15 applying the powdered low-melting point metallic material consisting of nonferrous metals into the melting cylinder. The feeding device 15 is constituted by a horizontal cylinder 15*a* and a screw shaft 15*c* in the inside thereof which is rotated by an electric motor 15*b* provided the end of the cylinder. Although being omitted in the drawings, it is constituted by a structure capable of attaching a heater for preheating the material to a surrounding of the cylinder as required.

The described-above melting cylinder 11 is provided with a nozzle member 10 on the tip, and provided with a band heater 16 on the outer periphery. The inside of the tip portion of the melting cylinder 11 communicating with a nozzle port of the described-above nozzle member 10 is formed as a weighing chamber 17 with a required length, which is reduced to a smaller diameter than an inner diameter of the melting cylinder. In the illustrated example, the inside the rear of the nozzle member 10 attached to the tip of the melting cylinder by a tip member 18 is reduced to a smaller diameter than the inner diameter of the melting cylinder, and the inside of the rear is formed as the weighing chamber 17 communicating with the inside of the melting cylinder, however, it may be the structure that the inner diameter of the tip member 18 is reduced in diameter to form as the weighing chamber 17 and to attach a nozzle tip to the tip member 18, if required.

A supply port 19 is arranged on an upper side of an intermediate portion of such melting cylinder, and the described-above feeding device 15 for the metallic material is connected to the supply port 19 through a pipe passage 20. Moreover, a rear end of the melting cylinder 11 is in the opened condition, and an agitating member 21 and an injection member 22 for the molten metal constituting the described-above agitating and injection means are arranged in the inside from the rear end to the inside.

Figure 4:
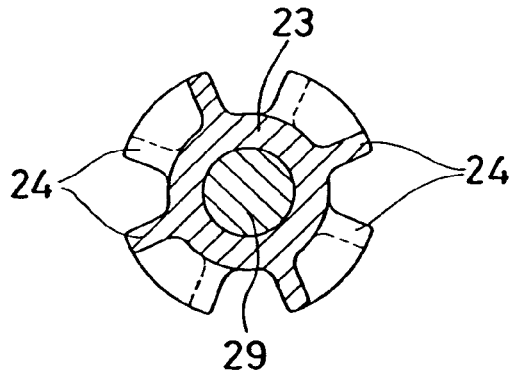
FIG. 4 is an end view of an agitating member, the end view being broken away longitudinally.

The described-above agitating member 21 is constituted by a revolution shaft that agitating wings 24 with a plurality of stripes are formed intermittently so as to swivel freely on an outer periphery of a tip portion of a hollow shaft portion 23 having a through-hole at the central position as shown in FIG. 4. These agitating wings 24 have an external diameter approximately equal to an inner diameter of the melting cylinder 11. Moreover, a flange 25 for a partition which a sealing ring closed proximity to an inner peripheral surface of the melting cylinder 11 is fitted to a the outer periphery is formed unitarily on a periphery of the shaft portion in the rear than the agitating wing 24 of the hollow shaft portion 23.

Moreover, a pulley 26 is fixed on the end of the described-above hollow shaft portion 23 projecting from an opening end of the melting cylinder 11, and a timing belt 28 is looped over this pulley 26 and a pulley 27 of a driving shaft end of the described-above electric motor 14, and the agitating member 21 is revolved by the electric motor 14 in the melting cylinder, and the molten metal can be agitated by the described-above agitating wings 24.

The described-above injection member 22 is constituted by an injection rod 29 inserted into a through-hole of the described-above hollow shaft portion 23 and to be provided slidably freely on a central position of the agitating member 21 and an injection plunger 30 attached to the tip end to fit to the described-above weighing chamber 17 from the front surface of the agitating member 21, and a screw 29*a* shutting off a molten metal intruded into a clearance between the hollow shaft portion 23 on intermediate region of the injection rod 29 is formed.

The described-above injection plunger 30 has an external diameter capable of inserting into the described-above weighing chamber 17 with a clearance for sliding, and the outer periphery of the tip portion is provided with the sealing ring for preventing a reverse flow of a molten resin from the clearance at injection. This sealing ring is a high-temperature resistant piston ring itself, made of special steel or the like.

Figure 5:
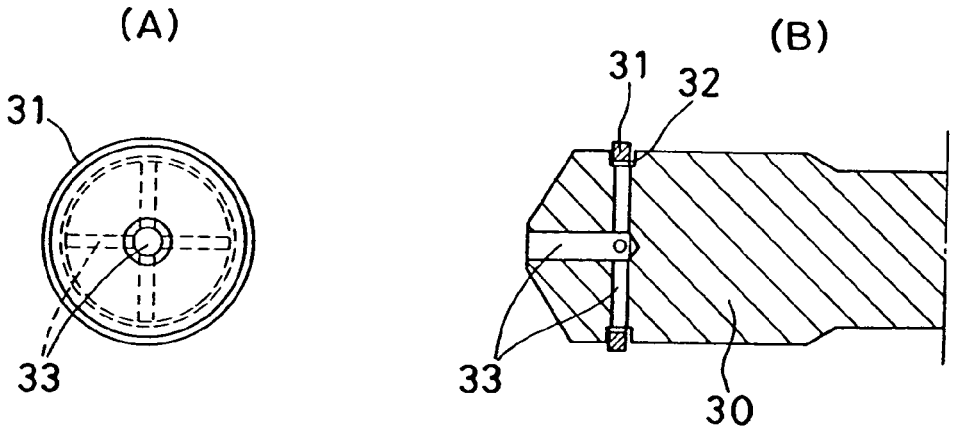
FIG. 5 is a front end view (A) and a side elevation (B) of an injection plunger of other embodiment, the side elevation being broken away longitudinally.

The injection plunger 30 shown in FIG. 5 shows other embodiment constituted by the structure that a flowing port 33 through an annular groove 32 for fitting, for the sealing ring 31 cut out and provided on the outer periphery side and the tip of the conical plunger is provided, and the annular groove 32 is communicated with the weighing chamber by the flowing port 33.

In such injection plunger 30, a pressure by resin pressurized with the tip of the plunger at injection by advancing and to be caused acts on the sealing ring 31 loosely fitted from the flowing port 33 to the annular groove 32 and to pressurize outwardly. According to this operation, the sealing ring 31 is extended to be pressed against the inner peripheral surface of the weighing chamber 17, whereby the reverse flow of the molten metal from the clearance for sliding can be prevented.

Moreover, the sealing ring 31 extended by a negative pressure caused due to a retreating movement within the weighing chamber of the injection plunger 30 at retreating the injection plunger 30 is reduced to an initial condition to cause the clearance again, as well as the molten metal stored by an aspirating action due to the negative pressure comes to flow into the weighing chamber 17 being extended from before reaching a retracting limitation of the plunger. According to this operation, the large negative pressure to the extent of making a forced retracting of the injection plunger 30 difficult can not be generated even in the case of type that the injection plunger 30 is retracted within the inside of the weighing chamber in an airtight condition, whereby the injection plunger 30 can be retracted smoothly.

The described-above injection cylinder 12 has integrally the same bifurcated-shape supporting leg 34 as the supporting leg 13 of the under side of the melting cylinder on the under side of the front end of the cylinder, and is provided with the electric motor 35 for revolving the injection rod on the rear end. This injection cylinder 12 is unitarily coupled by a tie-bar 36 arranged on both sides spacing an interval to the described-above melting cylinder 11, moreover, a piston 37 is coupled the rear end of the described-above injection rod 29 projected from the rear end of the described-above hollow shaft portion 23, whereby the injection rod 29 is moved in the advancing and/or retreating directions together with the injection plunger 30.

Moreover, the piston 37 is unitarily coupled only in the direction of the revolution through a driving shaft 38 of the electric motor 35 in the rear and an angular shaft or spline shaft 39 or the like and to revolve the described-above injection rod 29 by the electric motor 35 through the piston 37, whereby the molten metal intruded into the clearance of the surroundings of the rod can be fed frontward.

Such injection cylinder 12 and the described-above melting cylinder 11 are the ends of the described-above supporting legs 13 and 34 projected to both sides of the respective under side and arranged are inserted into support shafts 40 arranged side by side on both sides of an oblique-upper surface of the described-above frame 5, and are attached in a manner that the nozzle member 10 is placed on the lower side and is directed in a downward direction, thereby the described-above injection mechanism 1 installed obliquely to the described-above mold-clamping mechanism 2 to be constituted.

Moreover, on both sides of the injection mechanism 1, the tip of the rod 43 is attached so as to swivel freely to a bearing member 46 of both sides of an upstanding-nozzle touch block 45 arranged on a central position of the tip of a pedestal 4, while the hydraulic cylinder 42 is put on across the rear end of the melting cylinder and the front end of the injection cylinder, and the rear end of the cylinder is attached to the injection cylinder so as to pivot freely, thereby a nozzle touch device 44 constituted by the hydraulic cylinder 42 and a rod 43 with a long shaft to be provided.

Moreover, the described-above nozzle touch device 44 also functions as a retraction device on the occasion of a repair and maintenance of the injection mechanism 2.

In the frame 5 constituted by the described-above pair of plate bodies 5*a*, a support shaft 40 is attached to the inside of a plate body which an upper surface is formed on an surface inclined in an inward direction with an angle of approximately 45° with members 41 at both sides. This frame 5 is placed and arranged on a gate-type receiving seat 6 arranged on the rear end of the described-above pedestal 4 so as to swivel freely (not shown), and the nozzle touch device 48 of the nozzle member 47 provided horizontally on the front surface of the nozzle touch block 45 with member 52 across from a central position of the inside of the receiving seat 6 to the described-above nozzle touch block 45 is arranged.

Moreover, the nozzle touch block 45 and the nozzle member 47 are maintained at a set temperature by a heating device (not shown) provided on the outside.

A hydraulic cylinder 49 of this nozzle touch device 48 is fixed to a receiving member 50 of a central position within the pedestal 4 installed on the base 3, moreover, a rod member 51 coupled with a piston rod (not shown) in the inside the tip is coupled with the described-above nozzle touch block 45, and the pedestal 4 is moved in the advancing and/or retreating directions together with the injection mechanism 1 of the upper surface of the frame 5 by a movement of the advancing and/or retreating directions of the rod member 51, whereby a touch of the nozzle can be performed to a molding 7 of the described-above nozzle member 47.

The upper of the inside of the described-above nozzle touch block 45 is formed on an inclined rear surface positioning at the right angle to the nozzle member 10 of the described-above injection mechanism 1, and a gate for nozzle-touching is opened and arranged on inclined rear surface. Moreover, a hot runner 53 communicating the described-above nozzle member 47 with the nozzle member 10 of the injection mechanism 2 is bent and formed on the inside of the nozzle touch block, whereby nozzle-touching can be performed without a clearance and a leakage of the molten metal at injection and filling can be prevented, even though the injection mechanism 1 is installed obliquely on the mold-clamping mechanism 2.

In the described-above constitution, the melting cylinder 11 is isolated from the injection cylinder 12 and are unified by a tie-bar and both of them are installed on the upper surface of the frame 5 in a manner that the respective supporting leg 13 and 34 are inserted into the support shaft 40, whereby elongation due to thermal expansion becomes easy to be absorbed each other, so that a load due to thermal expansion is reduced even though the melting cylinder 11 is heated to high temperatures. Moreover, the injection cylinder 12 is provided in a manner to isolate the melting cylinder 11, whereby heating of an operating fluid due to thermal conduction from the melting cylinder side also can be prevented.

Figure 6:
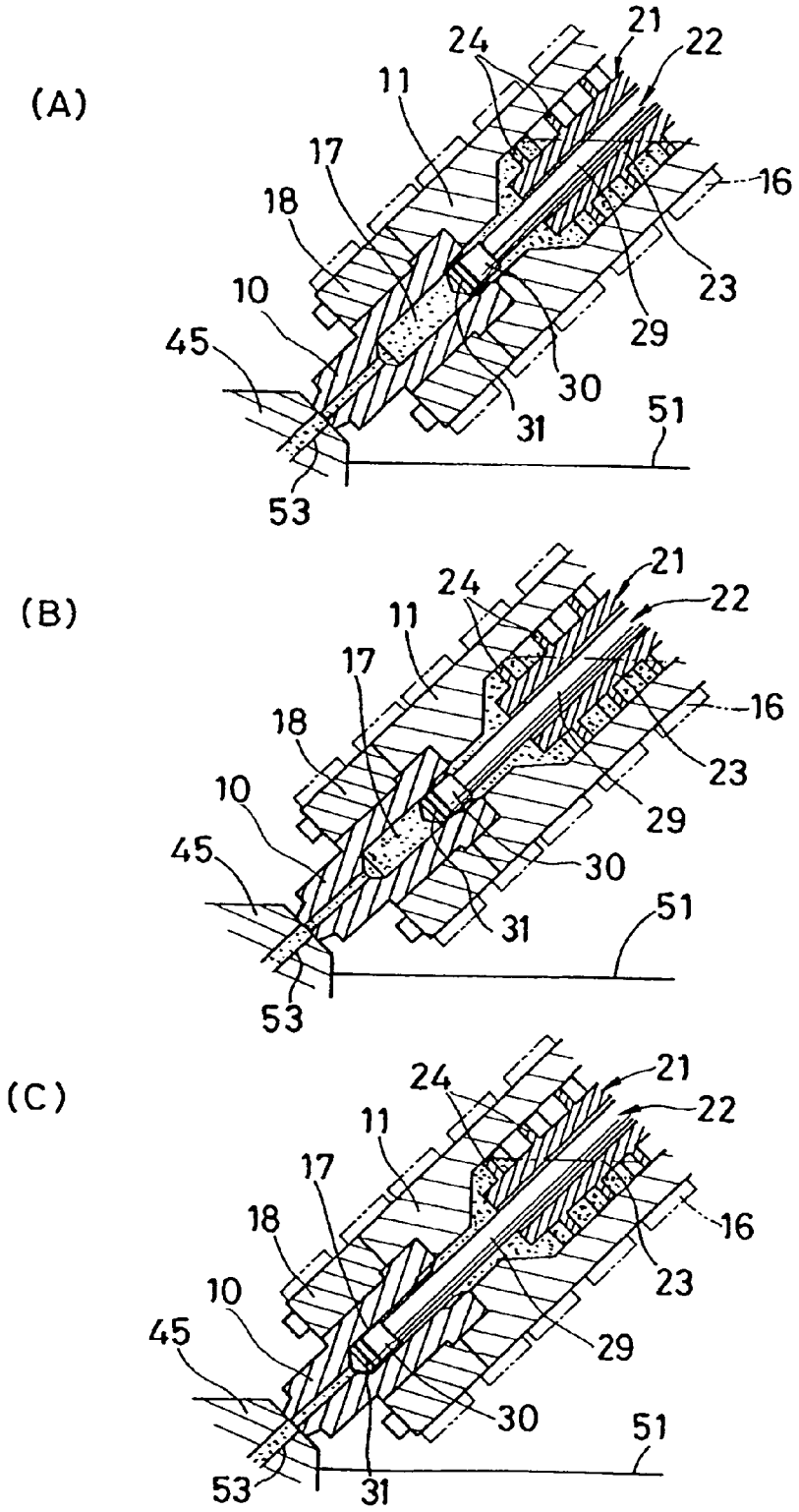
FIG. 6 is a side elevation of a front portion of a melting cylinder showing an injection molding process of a molten metal in order, the side elevation being broken away longitudinally.

Each drawing in FIG. 6 is a view showing a molding process of a low-melting point metal (magnesium).

First, the inside is raised to the high temperature than the melting point by heating the melting cylinder 11 by the band heater 16 of the outer periphery to temperature of approximately 620° to 680°. Next, the hollow shaft portion 23 is made an agitated condition by revolving using the described-above electric motor 14 with at a set speed. When applying the powdered metallic material into the melting cylinder 11 from the supply port 19 with the described-above feeding device 15 in such condition, the metallic material is fallen into the melt of the molten metal stored in the region of the agitating wings 24 being revolving together with the hollow shaft portion 23 immediately since the melting cylinder 11 is inclined in a downward direction, whereby it melts due to heat stored in the molten metal, as well as is mixed into the melt by the agitating wings 24. Therefore, it melts in an extremely short time.

The molten metal is stored within a front of the melting cylinder 11, when the injection plunger 30 is in the advancing position and stays in the weighing chamber 17. The amount to be stored may be approximately 10 shots, and molding can be performed continuously without interference if the material of one shot is applied every molding.

A part of the stored molten metal comes to flow into the weighing chamber 17 from the clearance of the surroundings, when the injection plunger 30 moves is moved in the retreating directions. The movement comes to a stop, when the injection plunger 30 reaches a retracting limitation. A plurality of flowing grooves (not shown) are provided spacing an uniform interval on the surroundings of the opening of the weighing chamber 17, and the sealing ring is designed to position at a midpoint of these flowing grooves at the retracting limitation of the plunger 30, whereby the weighing chamber 17 is communicated with the inside of the tip of the melting cylinder 11, and the molten metal flows into the weighing chamber 17 from the surroundings of the injection plunger 30 by self-weight (FIG. 6(A)).

Moreover, when the injection plunger 30 has the structure shown in FIG. 5, the described-above flowing groove of the surroundings of the opening can be omitted since the molten metal from the clearance of the surroundings of the plunger flows into the weighing chamber 17 because of the mentioned-above phenomenon.

At the time when storage of the molten metal to the weighing chamber 17 is completed, the process is switched to a weighing process, and the injection plunger 30 is moved in the advancing direction. The molten metal in the weighing chamber 17 would be pressurized to be weighed through this movement of the advancing direction. Although the molten metal is pressurized by the injection plunger 30, whereby a part thereof would flow in reverse from the clearance for sliding to flow out from the weighing chamber 17, the molten resin of the weighing chamber 17 can not be reduced in volume from a position which the sealing ring is advanced than the described-above flowing groove, since this reverse flow is prevented by the sealing ring of the surroundings of the plunger (FIG. 6(B)).

Therefore, when this position is set as a position which weighing is completed to switch a process to an injection and filling process thereafter and to move the injection plunger 30 in the advancing direction up to the tip position of the weighing chamber 17 shown in FIG. 6(C), the set amount of the molten metal can be inject and filled at all time.

Agitation of the molten metal by revolution of the described-above agitating wings 24 can be performed continuously, since the agitating member 21 and the injection member 22 are constituted separately, also during such injecting and filling from weighing. According to this operation, melting and keeping warm for the molten metal can be stabilized. Melting of the metallic material is performed by heating from the outside source, and the agitating member 21 has only to prevent nonuniformity in temperature of the metallic material in the melting cylinder molten by heating by revolution, and injecting and weighing is performed by the agitating member 21 in the central portion, whereby the melting efficiency of the metallic material can be performed.

Moreover, since the injection member 22 can not be revolved for the purpose of melting of the metallic material, the injection rod is not required to make into a large diameter such as the previous screw in consideration of revolving torque, and for the agitating member 21 also, a clearance between an inner-wall surface of the melting cylinder and an outer surface of the hollow portion large is formed since melting can not performed by heat generated by shear, and the amount to be stored can be increased than the case of using the screw, whereby a temperature-maintenance effect also can be improved more and more, and injection molding of low-melting point metallic material becomes possible with high molding accuracy.

While the presently preferred embodiment of the present invention has been shown and described, it will be understood that the present invention is not limited thereto, and that various changes and modification may be by those skilled in the art without departing from the scope of the invention as set forth in the appended claims.

What is claimed is:

1. An injection molding machine for low-melting point metallic material comprising:

an injection mechanism comprising a melting cylinder, an injection means and a driving device;

said melting cylinder having a supply port for a metal material disposed on an upper side of an intermediate portion, a metering chamber formed within a tip portion, the metering chamber having a selected length in communication with a nozzle member;

said injection means comprising an injection rod disposed within the melting cylinder so as to advance and retreat freely, and an injection plunger attached to a tip of the injection rod, the injection plunger being inserted into the metering chamber freely slidable; and said driving device disposed on a rear end of the melting cylinder for driving said injection means so as to advance or retreat;

a pedestal supporting said injection mechanism obliquely with the nozzle member directed downwardly to a mold clamping mechanism, the pedestal provided on an upper surface of a base so as to advance and retreat freely;

wherein:

a nozzle touch block is provided on a tip end portion of the pedestal and touched by said nozzle member obliquely;

a frame is provided on a rear portion of the pedestal and supports a rear portion of said injection mechanism and the driving device obliquely;

a nozzle touch device is provided for nozzle touching an injection nozzle attached to the front of the nozzle touch block to a mold in the mold clamping mechanism by moving the pedestal with said injection mechanism toward the mold clamping mechanism.

2. The injection molding machine for low-melting point metallic material according to claim 1, wherein said injection plunger has an external diameter insertable into the metering chamber, wherein the metering chamber has a diameter smaller than an inner diameter of the melting cylinder, with a clearance for sliding, and a sealing ring provided on an outer periphery of a tip portion of the injection plunger to prevent reverse flow of molten metal at injection.

3. The injection molding machine for low-melting point metallic material according to claim 1, wherein said driving device for said injection means comprises a hydraulic cylinder unitarily coupled by a tie bar to said melting cylinder spaced an interval from the rear end of said melting cylinder, wherein a nozzle touch device for nozzle touching said nozzle member to said nozzle touch block is provided across the side of the hydraulic cylinder and an upper tip portion of said pedestal.

4. The injection molding machine for low-melting point metallic material according to claim 1, wherein said nozzle touch block comprises;

an upper side of said nozzle touch block formed as an inclined rear surface for nozzle touching with the nozzle member of said injection mechanism;

a gate formed on said inclined rear surface; and a hot runner formed within the nozzle touch block connecting said gate and said injection nozzle.

5. The injection molding machine for low-melting point metallic material according to claim 1, wherein said frame has an upper surface inclined in an inward direction and installed on a seat on the rear end of the pedestal so as to swivel freely, and a support shaft provided on both sides of said inclined upper surface, wherein the rear portion of said injection mechanism and the driving device of said injection means are supported movably by said support shaft.

* * * * *

UNITED STATES PATENT AND TRADEMARK OFFICE

CERTIFICATE OF CORRECTION

PATENT NO. : 7,004,225 B2
APPLICATION NO. : 10/766736
DATED : February 28, 2006
INVENTOR(S) : Kiyoto Takizawa et al.

It is certified that error appears in the above-identified patent and that said Letters Patent is hereby corrected as shown below:

Column 1, line 9, “6,966,088” should read --6,866,088--.

Signed and Sealed this

Twenty-second Day of May, 2007

JON W. DUDAS
*Director of the United States Patent and Trademark Office*